US007451502B2

(12) United States Patent
Ball

(10) Patent No.: US 7,451,502 B2
(45) Date of Patent: Nov. 18, 2008

(54) BATH DRAIN CLOSURE ASSEMBLY

(75) Inventor: William T. Ball, Colorado Springs, CO (US)

(73) Assignee: WCM Industries, Inc., Colorado Springs, CO (US)

( * ) Notice: Subject to any disclaimer, the term of this patent is extended or adjusted under 35 U.S.C. 154(b) by 423 days.

(21) Appl. No.: 11/161,930

(22) Filed: Aug. 23, 2005

(65) Prior Publication Data

US 2007/0044230 A1 Mar. 1, 2007

(51) Int. Cl.
*E03C 1/23* (2006.01)

(52) U.S. Cl. ..... 4/689; 4/668

(58) Field of Classification Search ..... 4/668–669, 4/688–689, 693, 684
See application file for complete search history.

(56) References Cited

U.S. PATENT DOCUMENTS 775,020 A 11/1904 Waterman ..... 4/669
4,720,877 A 1/1988 Watts
5,363,519 A * 11/1994 Husting ..... 4/689
5,661,462 A * 8/1997 Shrewsbury-Gee ..... 340/618
6,418,570 B1 7/2002 Ball
6,546,573 B1 4/2003 Ball
2002/0121982 A1 * 9/2002 Ferris et al. ..... 340/612

FOREIGN PATENT DOCUMENTS

GB 2263060 * 7/1993
WO PCT/US98/24063 5/1999

* cited by examiner

*Primary Examiner*—Charles E Phillips
(74) *Attorney, Agent, or Firm*—Sheridan Ross P.C.

(57) ABSTRACT

A bath drain assembly for use with a bathtub having a drain closure device mounted to a bottom drain and a movable actuating member engaging the drain closure device such that the drain closure device is toggled between open an closed positions when activated. A control device is in electronic communication with a sensor adapted to sense water level of fluid contained within the bathtub such that the drain closure device is moved to an open position via the actuating member when the sensor detects a given water level.

9 Claims, 5 Drawing Sheets

BATH DRAIN CLOSURE ASSEMBLY

BACKGROUND OF THE INVENTION

This invention relates to a bathtub drain closure assembly. More particularly, this invention relates to a bath drain closure device that is opened and closed when the water level in the bathtub reaches a given level.

Bathtubs are often left unattended while filling. Accordingly, overflow drains are typically supplied to prevent overflow from the bathtub. However, even with overflow drains it is still possible for the bathtub to overflow if the overflow drain is of insufficient capacity or if a person suddenly enters an overfull bathtub.

It is therefore a principal object of this invention to provide a drain closure assembly for a bathtub which opens the bottom drain when the water level in the bathtub reaches a given level.

These and other objects will be apparent to those skilled in the art.

SUMMARY OF THE INVENTION

A bath drain assembly for use with a bathtub having a drain closure device associated with a bathtub drain and a movable actuating member engaging the drain closure device such that the drain closure device is toggled between open and closed positions when actuated.

A sensor, mounted in a position to detect the water level within the bathtub, provides a signal that changes the position of the actuating member which moves the drain closure device to an open position to allow water to drain from the tub.

DESCRIPTION OF THE DRAWINGS AND PHOTOS

DESCRIPTION OF THE PREFERRED EMBODIMENTS

Figure 1:
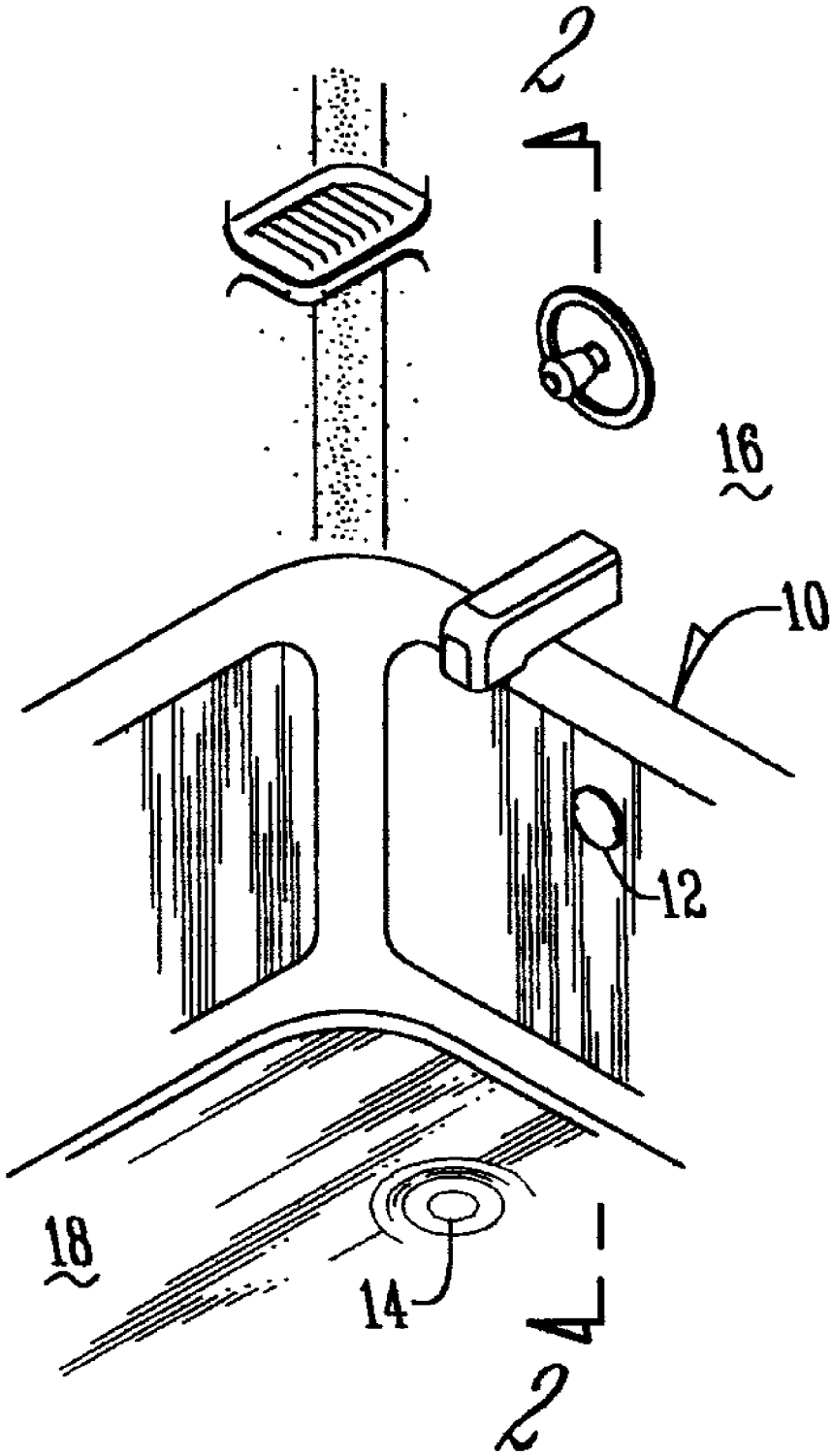
FIG. 1 is a perspective view of a bathtub environment.
Figure 2:
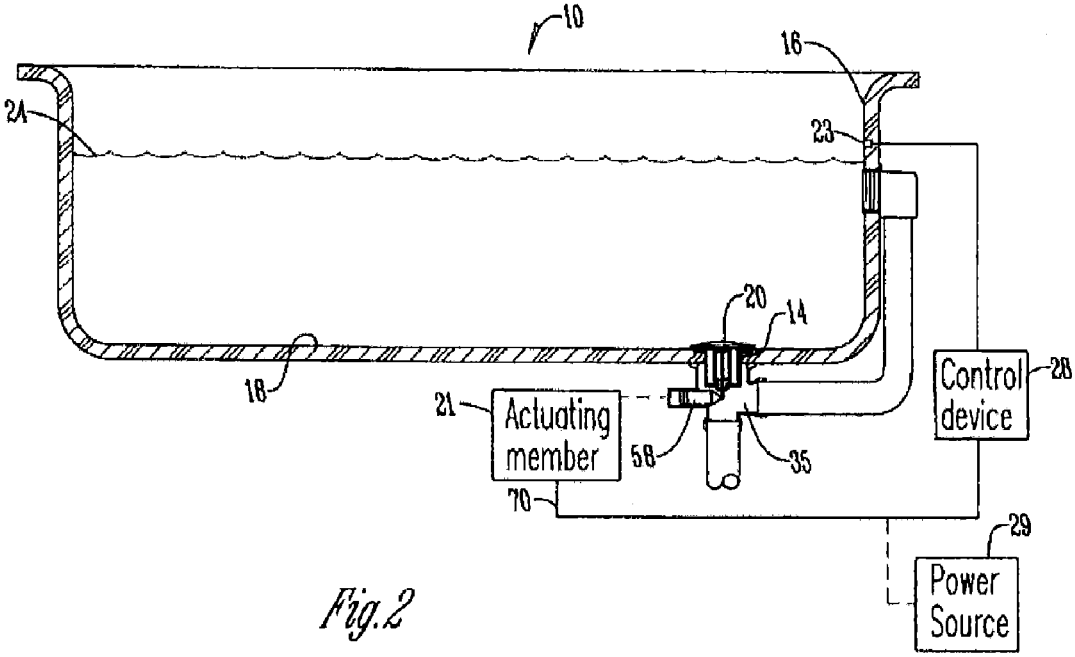
FIG. 2 is a sectional side view of a drain closure assembly associated with a bathtub taken along line 2-2 of FIG. 1.

With reference to FIGS. 1-7, a conventional bathtub 10 has an upper overflow drain 12 and a lower drain 14 (also referred to as a bottom drain). The upper overflow drain 12 is located at one end wall 16 of the bathtub 10 for draining overflow fluids from the bathtub 10. The lower drain 14 is located in the bottom 18 of the bathtub 10 for draining fluids from the bottom of the bathtub 10.

Figure 4:
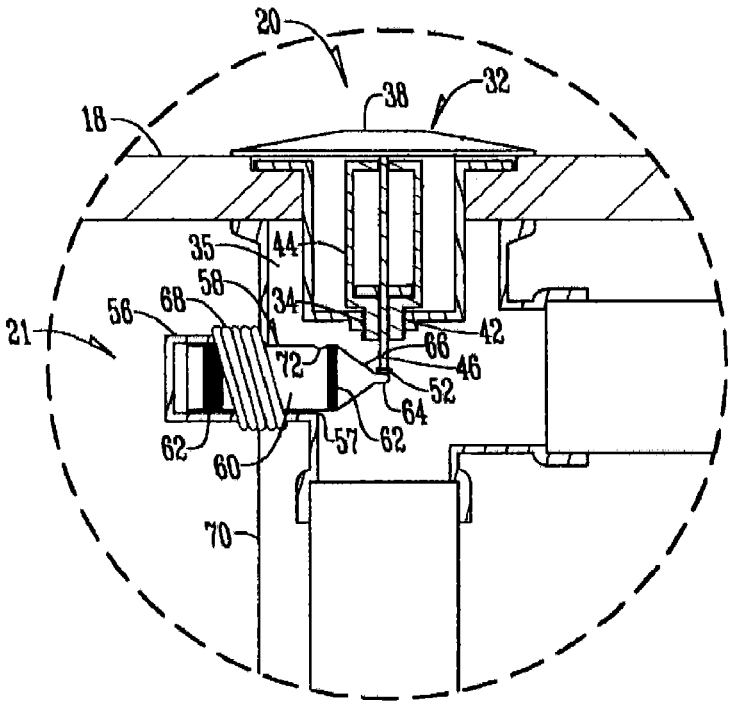
FIG. 4 is an enlarged sectional side view of an actuating member associated with a bathtub bottom drain.
Figure 5:
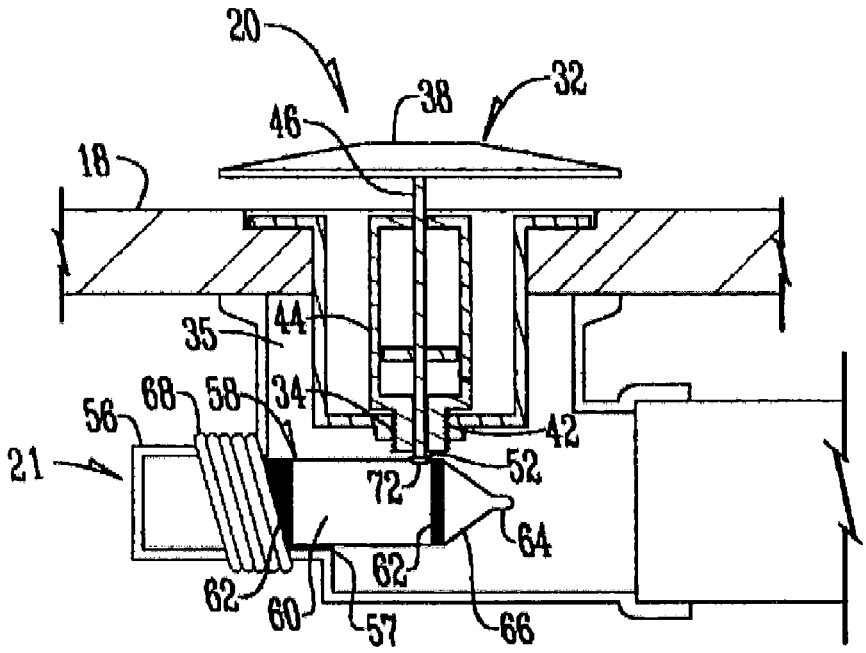
FIG. 5 is an enlarged sectional side view of the actuating member of FIG. 4 when activated.
Figure 6:
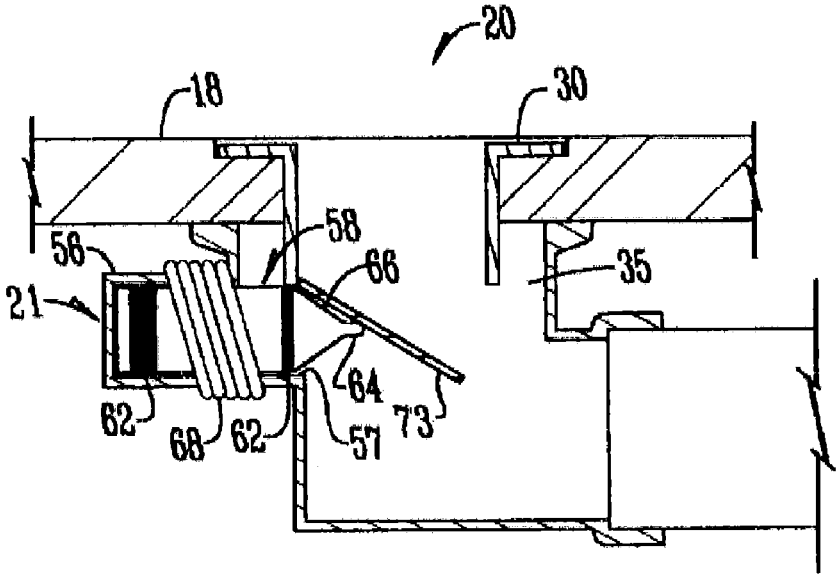
FIG. 6 is an enlarged sectional side view of another embodiment of an actuating member associated with a bathtub bottom drain.
Figure 7:
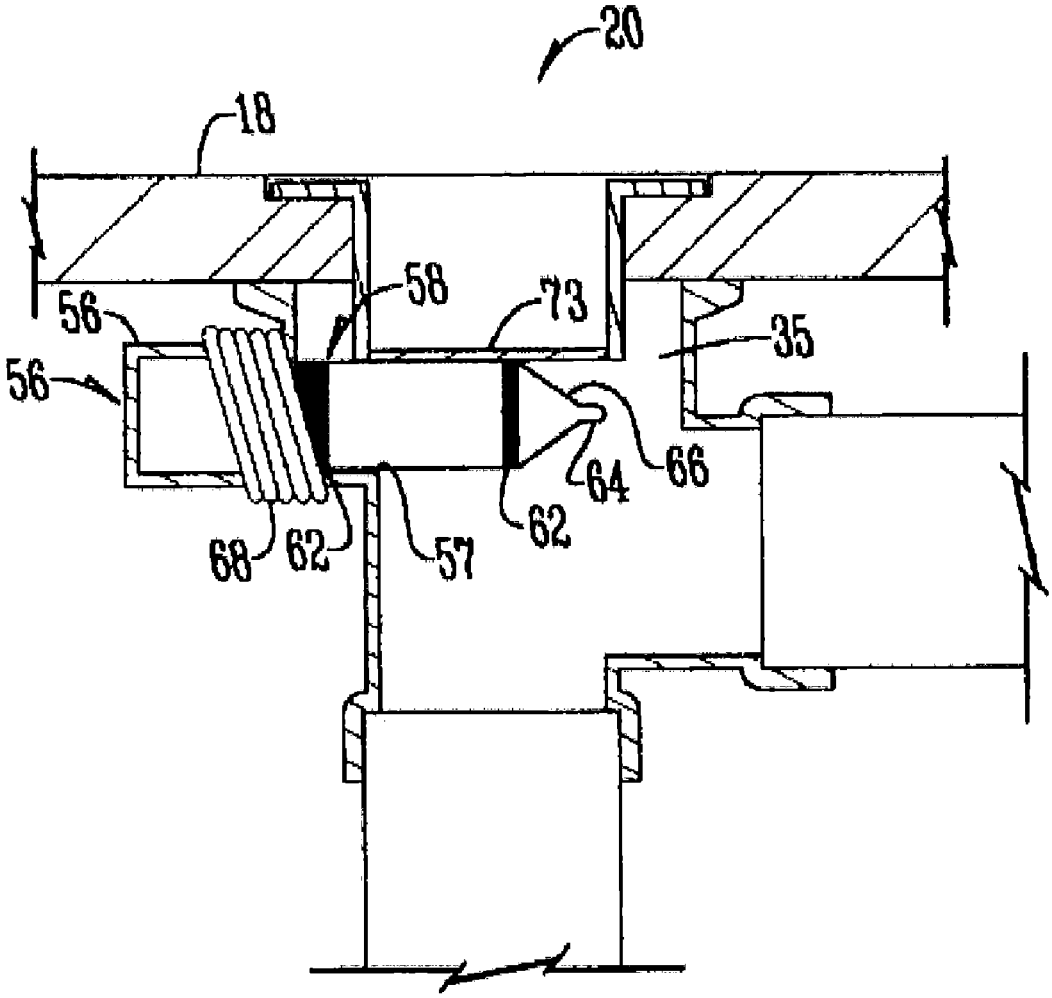
FIG. 7 is an enlarged sectional side view of the actuating member of FIG. 6 when activated.

The drain closure assembly 20 has a drain closure 32 associated with the lower drain 14 and an actuating member or mechanism 21 that is operatively associated with the drain closure device 32 to open and close the bottom drain 14. The drain closure device 32 is of many types. As one example and as shown in FIGS. 4 and 5 the drain closure device 20 has a stopper 38 with a stem 46 extending therefrom that is slidingly received in a nut portion 42 of a strainer body 30. The stem 46 is positioned within a hollow sleeve 44, wherein the shaft or a stem 46 that extends above and below the sleeve 44 and has an upper end connected to the stopper 38, and a lower end that terminates in a head 52. As another example, as shown in FIGS. 6 and 7, the drain closure device is a flap 73 that is movably connected to the bottom of the strainer body 30.

The actuating member 21 is of many types such as a solenoid, a motor, or the like. In one example, the actuating member 21 comprises a solenoid piston 58 having a main body 60 with first and second magnets 62 positioned at opposite ends of the main body 60. A conical tip 66 extends from one end of the main body 60 and engages the head 52 of the stem 46. The actuating member 21 is slidably received within a housing 56 that is in communication with conduit 35 such that a rim 57 supports the main body 60. The drain conduit 35 is of any configuration including those shown in FIGS. 3-6. Mounted around the housing 56 is a coil 68 that is located exterior to both the housing 56 and the conduit 35. Extending from the coil 68 is an electrical contact 70 that connects the actuating member 21 to control device 28. The control device 28 is connected to a power source 29 that provides an electrical charge to the coil 68. The power source 29 is of many types including but not limited to an electrical outlet. A transformer (not shown) may optionally be inserted between the power source 29 and the drain closure assembly 20 to modify power provided thereto. The control device allows a user to selectively move the actuating member 21 to open and close drain 14.

Figure 3:
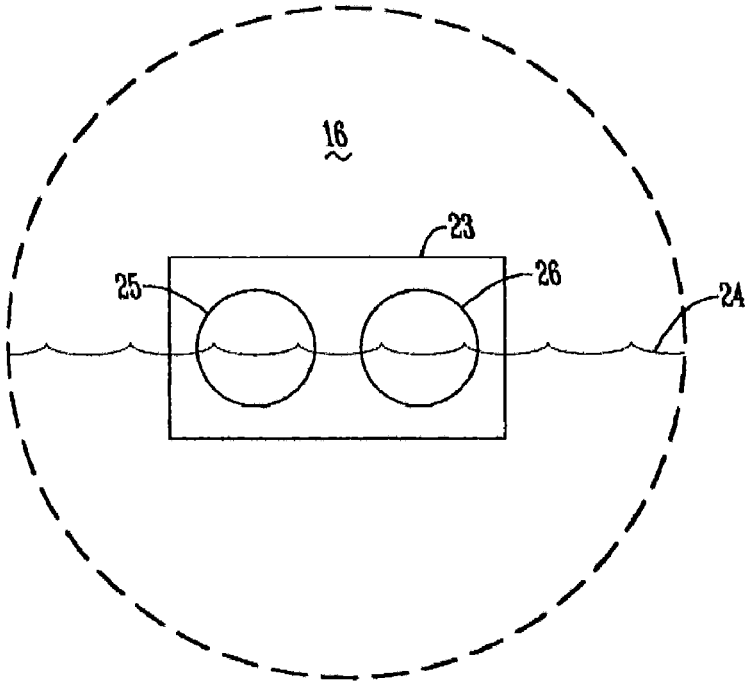
FIG. 3 is a front view of a sensor associated with a bathtub.

A sensor 23 is mounted in the bathtub 10 environment to sense the water level 24 contained within the bathtub 10. The sensor 23 is located in a variety of positions such a below the overflow drain 12, above the overflow drain 12, in the end wall of the bathtub opposite end wall 16, in the sidewalls of the bathtub 10, or within the overflow drain 12. The sensor 23 is of many types. One example, as shown in FIG. 3, includes first and second leads 25 and 26. The first and second leads 25 and 26 are spaced such that when the water level 24 rises to fill the space between leads 25 and 26 a complete circuit is formed. The sensor 23 is connected to the control device 28 which is connected to the actuating member 21. When a complete circuit is formed in sensor 23 a signal is communicated through the control device 28 that overrides the charge provided to the actuating member 21 to move the drain closure device 20 to an open position.

In operation, when a user wishes to fill the tub, a charge from the power source 29 is provided to the coil 68 to move the actuating member 21 which in turn moves the drain closure device 20 to a closed position to allow the tub to fill with fluid. As the water level rises to a point where the water level 24 completes the circuit between first and second leads 25 and 26 of sensor 23, then a signal is sent from the sensor 23 to control device 28 which in turn interrupts the charge supplied to the drain closure assembly such that the actuating member 21 is activated and the drain closure device 20 is moved to an open position to allow water to drain from the tub 10. In one embodiment, when the water level 24 falls such that a complete circuit is no longer formed in sensor 23, the original charge from the power source 29 is restored and the drain closure assembly 20 returns to an open position.

With specific reference to FIGS. 4 and 5, one embodiment of the present invention is shown wherein the actuation member 21 is shown in the first position of use such that the drain closure device 32 is positioned against the bottom 18 of the bathtub. The solenoid piston 58 is shown positioned in the first position of use inside the activation switch 56. The stem 46 is positioned in the downward position such that the head 52 thereof is situated on top of a protuberance 64 that is interconnected to the solenoid piston 58. If the sensors indicate a situation where overflow is eminent, a signal is sent to the control device that sends an electrical current through the control device 70 into the coil 68. As one of skill in the art will appreciate, energizing the coil 68 will create a magnetic field that interacts with the magnets 62 positioned on the main body 60 of the solenoid piston 58. The repulsive effect of the interaction between the energized coil 68 and the magnets 62 will move the solenoid piston 58 relative to the stem 46. Accordingly, the head 52 of the stem 46 will travel from the protuberance 64 and up the conical surface 66 of the sensor 58. Preferably, a groove 72 is provided on the main body 60 that receives the head 52. The movement of the solenoid piston 58 thus necessarily moves the stem 46 upwardly and moves the hollow sleeve 32 to a second, open position to allow fluid to flow from the bathtub and through the conduit 35.

Referring now to FIGS. 6 and 7, yet another embodiment of the present invention is shown that employs a traditional strainer body 30 that is interconnected to a conduit 35. This embodiment of the present invention, as previously described above, employs a flap 73 that is selectively opened and closed to allow fluid through the strainer body 30 into the conduit 35. In a first position of use, as shown in FIG. 7, the solenoid piston 58 is positioned such that the flap 73 is closed so that water can fill the bathtub. When the liquid level in the bathtub reaches a predetermined depth, the coil 68 is energized, thereby creating a repulsive magnetic force that interacts with the magnet 62, as described above. The repulsive magnetic force moves the solenoid piston 58 to a second position of use, which opens the flap 73, thereby allowing fluid to travel from the bathtub and into the conduit 35.

Therefore, as shown from the preceding description the stated objective has been accomplished.

What is claimed is:

1. A bath drain assembly for use with a bathtub having a bottom with a drain, end walls, and sidewalls, comprising:

a drain closure device operatively associated with the drain to open and close the drain;

an actuating member that engages the drain closure device to move the drain closure device from an open position to a closed position, said actuating member being a substantially cylindrical member having at least one magnet positioned thereon and having a conical portion with a protuberance extending therefrom;

a coil positioned about the actuating member such that when exposed to a current, the actuating member moves from a first position of use, wherein a stem of the drain closure is situated on top of said protuberance and said drain closure device is in said open position, to a second position of use wherein said stem of the drain closure rests on a cylindrical portion of said actuating member after being moved along said conical portion and said drain closure is in said open position; and a sensor adapted to sense a pre-selected level of water and send a signal activating the actuating member to move the drain closure device to the open position when the water level is sensed.

2. The bath drain assembly of claim 1, wherein the actuating member is a solenoid.

3. The bath drain assembly of claim 1, wherein the sensor includes a first and second lead and adapted to form a complete circuit when the water level rises to contact the first and second leads.

4. The bath drain assembly of claim 1, wherein the bathtub includes an overflow drain in an end wall of the bathtub, and wherein the sensor is located above the overflow drain.

5. The bath drain assembly of claim 1, wherein the bathtub includes an overflow drain in an end wall of the bathtub, and wherein the sensor is located below the overflow drain.

6. The bath drain assembly of claim 1, wherein the control device is an electronic circuit.

7. The bath drain assembly of claim 1, wherein the control device is a computer.

8. The bath drain assembly of claim 1, wherein the bathtub includes an overflow drain in an end wail of the bathtub, and wherein the sensor is located within the overflow drain.

9. The bath drain assembly of claim 1, further comprising a control device connected to the sensor.

* * * * *

UNITED STATES PATENT AND TRADEMARK OFFICE

CERTIFICATE OF CORRECTION

PATENT NO. : 7,451,502 B2
APPLICATION NO. : 11/161930
DATED : November 18, 2008
INVENTOR(S) : Ball It is certified that error appears in the above-identified patent and that said Letters Patent is hereby corrected as shown below:

Claim 8, column 4, line 37, delete “wail” and insert --wall-- therefor.

Signed and Sealed this

Thirty-first Day of March, 2009

JOHN DOLL
*Acting Director of the United States Patent and Trademark Office*